United States Patent [19]

Mathieu et al.

[11] 3,965,999

[45] June 29, 1976

[54] DRILLING GRAB FOR PILE FOUNDATIONS AND WELL BOREHOLES

[75] Inventors: Hans Mathieu, Bischmisheim; Jürgen Hochstrasser, Saarbrucken, both of Germany

[73] Assignees: Elisabeth Hochstrasser nee Wack; Jurgen Hochstrasser, both of Germany

[22] Filed: Jan. 29, 1975

[21] Appl. No.: 545,104

[30] Foreign Application Priority Data

Jan. 31, 1974 Germany ..... 2405142

[52] U.S. Cl. ..... 175/238; 37/187; 175/242

[51] Int. Cl.[2] ..... E21B 11/04

[58] Field of Search ..... 175/238, 232, 241, 242, 175/173, 274, 285, 291, 317; 37/183–188

[56] References Cited

UNITED STATES PATENTS

| | | | |
|---|---|---|---|
| 1,985,710 | 12/1934 | Allard | 37/187 |
| 3,113,629 | 12/1963 | Allard | 175/238 |

FOREIGN PATENTS OR APPLICATIONS

| | | | |
|---|---|---|---|
| 1,045,176 | 6/1953 | France | 175/238 |
| 1,145,610 | 5/1957 | France | 175/242 |
| 886,582 | 7/1953 | Germany | 175/274 |
| 490,282 | 8/1938 | United Kingdom | 175/238 |

*Primary Examiner*—James A. Leppink
*Attorney, Agent, or Firm*—Basile and Weintraub

[57] ABSTRACT

A drilling grab for pile foundations and well boreholes wherein the drilling grab comprises a grab body supporting circular grab spades which tilt from an open position to a closed position about pivot pins carried by the grab body. A radially projecting abutment interchangeably connected to the outer periphery of the grab body is engageable with the back of the grab spades when the same are in an open position. The abutment overlaps the periphery of the grab body and is characterized in that they consist of extension members adapted to grab spades of different sizes. The members are supported on radially projecting ribs located on the grab body.

8 Claims, 10 Drawing Figures

DRILLING GRAB FOR PILE FOUNDATIONS AND WELL BOREHOLES

BACKGROUND OF THE INVENTION

1. Field of the Invention

The invention relates to a drilling grab for pile foundations and well boreholes.

2. Description of the Prior Art

Drilling grabs of this type serve in particular for producing drill holes in the ground for concrete piles. They consist of a grab body, which supports circular grab spades at its end, which spades are able to tilt from an open position into a closed position about pins located in the grab body.

In these known drilling grabs, the opening and closing of the spades takes place by a mechanism in the form of a toggle lever actuated externally, for example, by a cable. The grab spades are kept open by a locking mechanism; and when the drilling grab is lowered, the open spades penetrate the earth under the action of the weight, whereupon they are closed by the actuation of the opening mechanism and withdrawn from the drill hole with the earth carried therebetween.

In another known drilling grab, the grab spades are opened by spring force and closed against the spring force by the cable of a winch. In this case, provided between the grab body and the opening mechanism of the grab spades actuated by a tie-rod attached to the winch cable is a spring force produced by one or more springs, which force is less than the weight of the grab body, but is so great that it opens the grab blades during the descent of the grab with additional acceleration of the winch cable and winch drum. When lowering the drilling grab by means of the winch cable attached to the tie-rod, the spades are kept closed against the spring force by the weight of the grab body. At the drilling point, the winch cable and winch drum are released so that the drilling grab falls freely. In this case, the grab spades are opened by the spring force coming into operation so that they may penetrate the earth. When pulling on the winch cable with the grab body in the inoperative position, the grab spades are first closed against the action of the spring force, whereupon the grab body with the closed spades is raised by the winch cable. A drilling grab of this type is described in German Pat. Nos. 1,058,953 and 1,280,776.

In all known drilling grabs, in the open position of the spades, the backs of the spades are supported on the lower edge of the grab body in order to transmit to the grab body the forces acting on the blades during the penetration of the spades into the ground. To achieve a varying angle of opening of the grab spades, it is already known to detachably connect intermediate parts serving as abutments to the front edge of the grab body and to the backs of these spades. In drilling grabs, it is also known to provide a radially projecting support on the periphery of the grab body for the spades adapted in their dimensions to the drilling grab housing, which support forms an abutment for the backs of the grab spades located in the open position slightly overlapping the periphery of the grab body. This abutment surrounds part of the grab spades and is attached to the grab body by screws. With this known abutment the forces occurring in the radial and axial direction of the grab body, produced by the spades, must be absorbed by the securing screws of the abutment, which must lead to rapid wear of the securing screws and thus also of the abutment, when they have been in operation for a long time.

In known drilling grabs, the diameter of the grab body with its spades is designed for a certain diameter of the drill hole. In the production of drill holes, in particular for pile foundations, it is nevertheless necessary to produce drill holes with considerably varying diameters, in order that the foundation piles inserted in the drill holes correspond to the necessary loads. Drill holes are generally required to have diameters of 850, 900, 1000, 1100, 1200, and 1250 mm. In order to eliminate the storage of a corresponding number of different drilling grabs, it is therefore necessary to be able to use a drilling grab housing of the smallest dimension by exchanging spaces of corresponding dimensions for the production of various drill holes. Different spades have already been associated with one and the same grab body, in which the inclination of the shovel blades to the back of the spade is different, so that when the grab spades are open, different distances corresponding to the desired diameter of the drill hole occur between centers. When using spades with larger distances between centers, the drawback exists that spades with shovel blades directed obliquely outward have great difficulty in penetrating solid ground. Furthermore, the bearings and pivot points of the spades are subject to such considerable loads, which result in rapid wear, that the use of such exchangeable blades is prohibited. In order to avoid these drawbacks, the grab body is constructed of two halves divided at right angles to its axis, which halves may be connected to each other by flanges and in which the lower halves of the grab body are adapted to the desired diameter of the drill hole. In this case, it is naturally necessary to have available a number of lower halves of the grab body corresponding to the number of different diameters of the drill holes. This naturally involves considerable cost and additionally considerable expenditure of energy during the necessary exchange of the lower halves of the grab body and the spades, especially since the exchangeable lower halves of the grab body have considerable weight.

SUMMARY OF THE INVENTION

It is the object of the invention to obviate these drawbacks existing in the known embodiments of drilling grabs by providing a drilling grab in which grab spades of varying sizes may be used selectively with one and the same grab body, whose diameter corresponds to the smallest diameter of drilling hole required, solely a simple exchange of the spades being necessary without excessive manifestations of wear occurring at the bearings of the spades and of the grab body.

This object is fulfilled according to the invention in that the abutment consists of extension members adapted to grab spades of different sizes, which members are supported on radially projecting ribs located on the grab body.

A further feature is that at their surfaces adjacent to the ribs, the extension members have a width corresponding to the width of the ribs, and at their surfaces coming into engagement with the backs of the grab spades, they have a surface adapted to the respective size of the spade. In the drilling grab according to the invention, for the substitution of large spades, it is solely necessary to attach extension members to the periphery of the grab body, which members are adapted to the respective size of the backs of the spades, so that when the spades are open, the backs of the spades are supported over their entire length on the grab body by means of the ribs serving as abutment shoulders, so that the entire force acting on the grab spades is transmitted to the grab body by the backs of the spades and harmful stress on the bearings is eliminated.

In drilling grabs with spades slightly overlapping the periphery of the grab body, the invention is characterized in that the extension members are constructed as cross-pieces located at intervals. In the case of spades corresponding to the periphery of the grab body, these cross-pieces serve as sliding cross-pieces.

In the case of drilling grabs with spades overlapping the diameter of the grab body to a greater extent, the invention is further characterized in that the extension members are curved members, which in width correspond to the back of the drilling grab and feature two fork-like extensions which are open towards the bottom.

A further feature of the invention is that the cross-pieces are fixed on the grab body and their lateral surfaces are constructed to extend in the form of a dove-tail; the internal sides of the curved extension member have grooves corresponding to the cross-pieces, forming a plug connection with the cross-pieces.

In the case of drilling grabs with spades which pass into the shovel blade with a wall inclined obliquely outwards at the end of the back of the spade, the invention is further characterized in that right-angled projections are provided bridging the obliquely inclined wall. These projections may be supported on the extension member when the spades are open and are detachably connected to the spades.

In drilling grabs with spades overlapping the grab body, the invention is characterized in that the radii of curvature of the spades are dimensioned such that in the closed position the spades lie inside the peripheral line of the grab body when the extension members are removed. Due to the dimensions according to the invention of the radii of curvature, with a grab body equipped with larger spades, narrowing of the drill hole which corresponds to the diameter of the grab body may be undertaken without difficulties after proceeding with a narrow point of the drill hole. A continuation of drilling is possible with a greater diameter corresponding to the spades. However, in a case of this type, the use of the extension members corresponding to the spades must be dispensed with.

A further feature of the invention consists in that the curved extension members are provided with downwardly directed bases overlapping the edge of the grab body and receiving the spades, which bases are provided on their inner sides with recesses, located at intervals, provided to receive solid journal bearings for the spades. This embodiment of the extension members is advantageous in spades which considerably exceed the dimensions of the drilling grab, for example when grab spades with a diameter of 1200 to 1250 mm are intended to be used with a drilling grab having a diameter of 850 mm.

BRIEF DESCRIPTION OF THE DRAWINGS

The accompanying drawings show embodiments of the invention.

DESCRIPTION OF THE PREFERRED EMBODIMENTS

Figure 1:
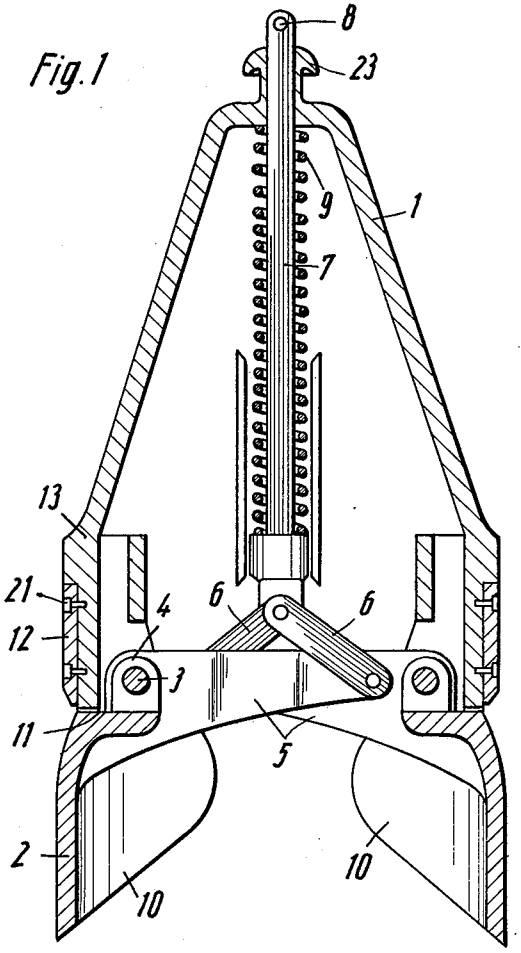
FIG. 1 is a cross-section through the grab with spades adapted to its diameter and illustrated with protective plates located on the sides of the grab.

FIG. 1 shows a drilling grab which consists of a grab body 1, having tilting spades 2 located on its underside, with solid journal bearings 4 located on the spades backs 11. These bearings 4 rotate on pins 3 provided in the grab body 1. Each spade 2 has a blade 10 and an arm 5 attached thereto, on which a lever 6 acting in the manner of a toggle joint is located, one end of which rotates at the end of the arm 5 and the other end of which is attached to a tie-rod 7, which comprises a bore 8 for securing a winch cable, which is not shown, at its end projecting with respect to the grab body 1. Located between the upper base of the grab body 1 and the lower end of the tie-rod 7 is a spring 9. When the grab body 1 is lowered, suspended from the winch cable, owing to the weight of the grab body 1, the spades 2 are in the closed position. When the winch cable and the winch drum (not shown) are released, the grab body 1 falls freely downwards, the spring 9 thus opening the grab spades 2, which dig into the earth in the open position under the action of the falling energy of the grab body 1. When the winch cable is pulled, the tie-rod 7 is drawn upwards against the action of the spring 9 and closes the grab spades 2. During further pulling on the taut winch cable, the grab body 1 with the closed grab spades 2 is raised.

Figure 7:
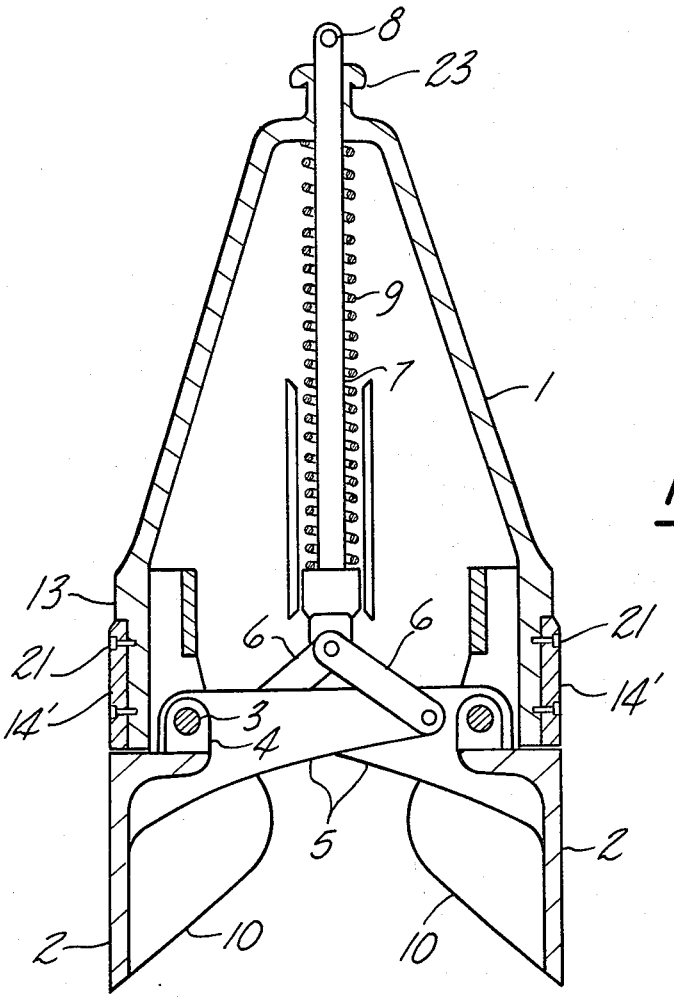
FIG. 7 is a view similar to FIG. 1 with wider spades and with supporting extension members in place of the protective plates shown in FIG. 1.

Located on the periphery of the conical grab body 1 is a projecting rib 13, which forms an abutment shoulder. Below the abutment shoulder, protective plates 12 bearing against the latter are detachably connected by screws 21. When using the normal grab spades according to FIG. 1, these protective plates 12, which are distributed at intervals over the periphery of the grab body 1, act as a means to protect the underlying surface of the grab body 1 and the surface defined in the projecting rib 13 from damage by stones and the like when the cross-pieces 14' and the extension members 14 are desired to be used as described hereinafter. In the case of spades 2, whose backs 11 exceed the spades illustrated in FIG. 1 by the thickness of the protective plates 12, the protective plates 12 are removed and replaced by extension members 14′ which are shown in FIG. 7 and which serve as an abutment for the edges of the backs 11 of the spades 2.

Figure 2:
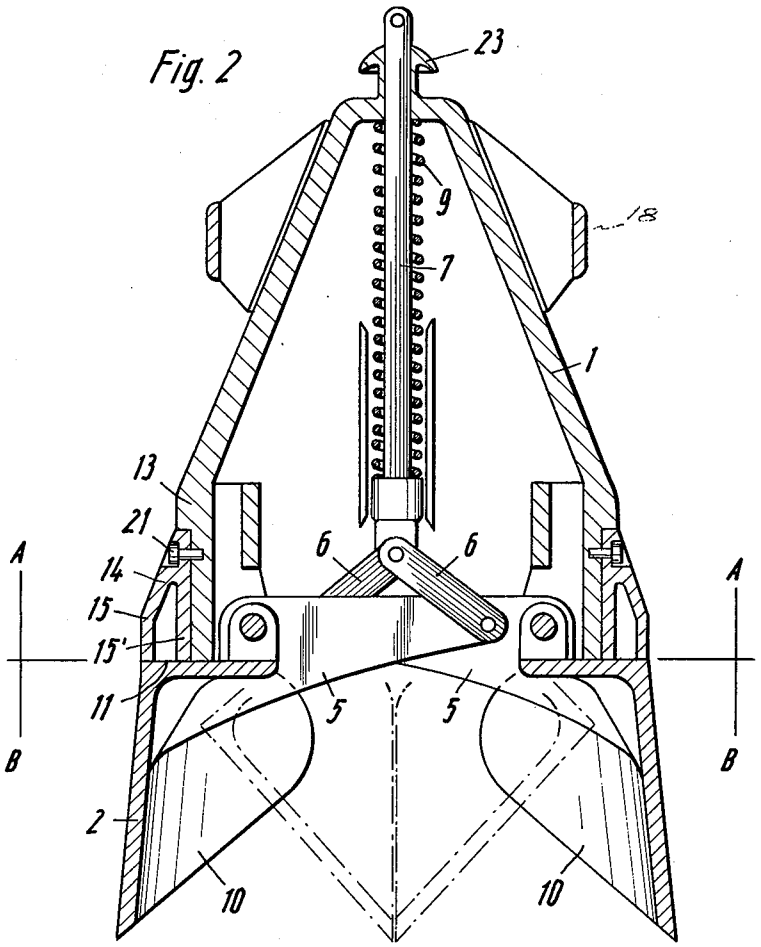
FIG. 2 is a view according to FIG. 1 with wider spades with supporting cross-pieces illustrated on the sides of the grab in place of the protective plates shown in FIG. 1.

As shown in FIG. 2, the grab body 1 according to FIG. 1 is equipped with spades which have a larger back surface 11. In this embodiment, in place of the protective plates 12, or the extension member 14′, extension members 14 are provided, which are supported by their upper end against the rib 13 serving as an abutment shoulder and widen out in a conical shape towards their lower end and form two cross-pieces 15 and 15′ such that the entire back 11 of the spade 2 is supported. On the extension members' surfaces adjacent the projecting ribs 13, the extension members 14 have a thickness corresponding to the thickness of the projecting ribs 13; and at the extension members' surfaces adapted to come into engagement with the back surface 11 of the grab spades 2, the extension members 14 have a thickness adapted to the respective size of the spade 2. The extension member 14 and cross-pieces 14′ are detachably connected to the grab body by screws 21.

Figure 10:
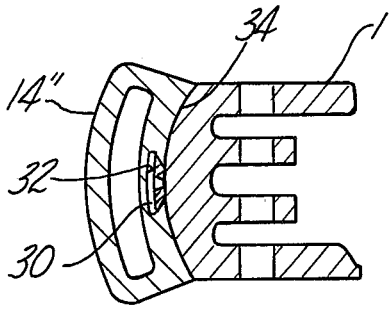
FIG. 10 is a fragmentary cross-sectional view similar to FIG. 8 illustrating an alternate embodiment in the form of a dove-tail connection of the extension member with the side of the grab body.
Figure 8:
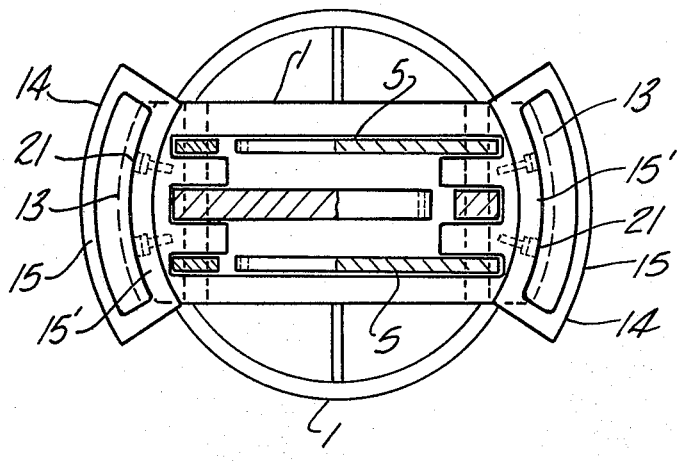
FIG. 8 is a cross-sectional view of the grab taken along Line A—A of FIG. 2.
Figure 9:
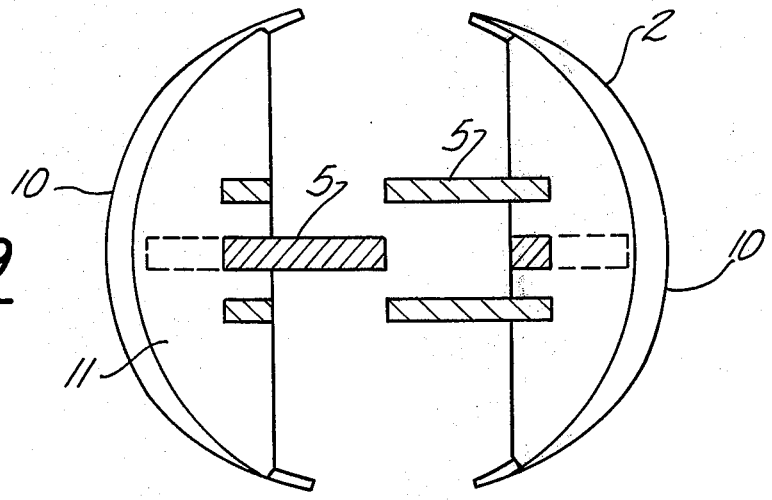
FIG. 9 is a cross-sectional view of the grab taken along Line B—B of FIG. 2.

In an alternate embodiment of the extension members 14, the side surfaces of the grab body 1 (which are adapted to normally accept the protective plates 12 or the cross-pieces 14′) may be constructed in a dove-tail shape, as illustrated in FIG. 10 of the drawings and designated by the numeral 30. The inside curved surface 34 of the side 15′ is provided with a corresponding recess 32 so that each modified extension member 14″ (after a modified protective plate of a similar shape and design has been removed from the side of the grab body 1) may be pushed from below onto the dove-tail shaped section 30 until the top surface of the extension member 14″ abuts the projecting rib 13. A securing screw 21 is for preventing the extension members 14″ from falling out of the dove-tail 30 when the spades are closed. As shown in the dot-dash line of FIG. 2, when the spades 2 are closed, the outer edges of the back surfaces lie inside the periphery of the grab body 1.

As shown in FIGS. 2 and 1, when exchanging the spades, it is solely necessary to remove the spades 2 from the pins 3 and to slide the larger spades according to FIG. 2 onto the same pins, it being necessary to release the levers 6 from the arm 5 of the spades and after the substitution of new spades to once more connect them to the arms 5 of these spades. As shown in FIG. 2, detachably located on the upper end of the grab body 1 is a ring 18, which serves as a guide. Bars which are not shown may also be used in place of the ring 18. At their upper ends, the drilling grabs according to FIGS. 1 and 2 support a coupling 23, by which the drilling grab is retained in the raised position, so that at the time of loosening the winch rope, the spades open for the purpose of emptying under the action of the spring force and of the earth retained thereby. When the coupling 23 is released, the empty grab spades close under the action of the weight of the grab body 1, whereupon the drilling grab may once more be lowered.

Figure 3:
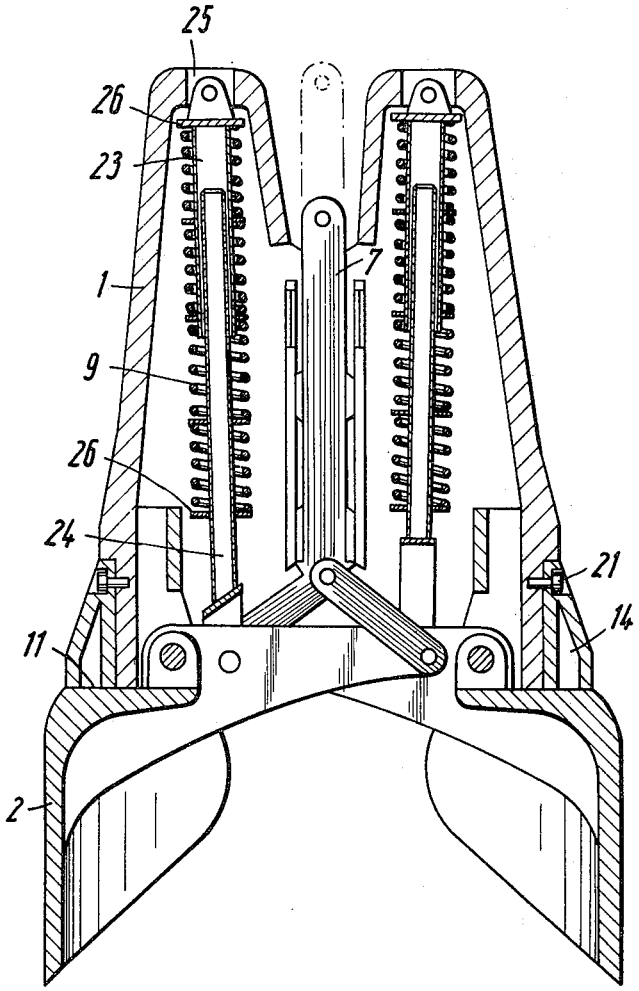
FIG. 3 is a view according to FIG. 2 of a grab with two springs.

With respect to the arrangement of the grab spades 2 and extension members 14, FIG. 3 corresponds to FIG. 2. In place of the grab body 1 illustrated in FIG. 2, the grab body comprises two springs 9. Each spring 9 is received on tubes 23 and 24 engaging telescopically one in the other, whereof the tube 23 is arranged to tilt in a recess 25 of the grab body and the tube 24 is likewise supported so that it may tilt on the arm 5 of the associated spade. The spring 9 is stretched between abutments 26, whereof one is attached to the tube 23 and the other to the tube 24. In this embodiment, in addition to the winch cable attached to the tie-rod 7, serving for opening and closing the spades, a second winch cable (not shown) is attached to the grab body 1. The method of operation of this embodiment is as follows:

When the drilling grabs are held in the raised position by the winch cable of the grab body, the winch cable of the tie-rod 7 is pulled, so that the spades 2 are closed against the action of the spring 9 and the rope attached to the grab body 1 slackens. In this position of the tie-rod 7 illustrated in dot-dash line in FIG. 3, the drilling grab is introduced into the borehole and lowered as far as the desired drop point. Then, the winch cable attached loosely to the grab body 1 is pulled so that the grab spades 2 open under the action of the pre-stressed springs 9 and come to bear against the extension members 14 with their backs 11. Subsequently, the winch drums of both cables are released and during the free fall of the drilling grab, the grab spades 2 dig into the ground, the forces acting on the spades 2 being transmitted to the drilling grab housing by way of the contact surfaces of the grab body 1 and the extension members 14. Then, when the winch cable attached to the tie-rod 7 is pulled, the spades 2 close and the drilling grab is withdrawn from the borehole while being suspended from this cable. To empty the drilling grab, the winch cable attached to the grab body 1 is pulled; the grab spades 2 open under the action of the pre-tensioned springs 9 and come to bear abruptly against the contact surfaces of the grab body 1 and extension members 14, so that even sticky drilling material is loosened from the grab spades. The aforementioned process is repeated for renewed actuation of the drilling grab.

The exchange of spades of different sizes is possible in a simple and time-saving manner. It is solely necessary to disconnect the arms 5 from the levers 6 and after removing the pins 3, to remove the spades 2 from the grab body 1. Then it is solely necessary to introduce spades of another size into the drilling grab 1, to connect the levers 6 to the arms 5 of the spades 2, and to provide extension members 12 or 14 corresponding to the new spade size. Extensive assembly work is dispensed with.

Figure 4:
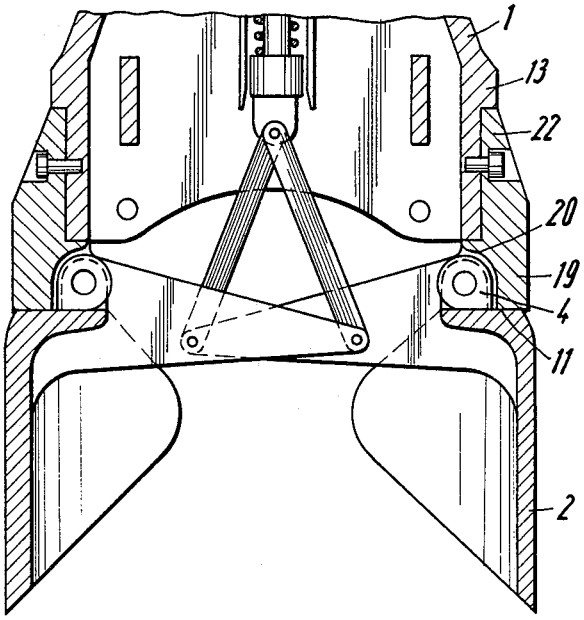
FIG. 4 is a view according to FIG. 2 in the case of a modified embodiment of the extension member.

FIG. 4 shows a drilling grab according to FIG. 2, whose grab body 1 is provided with substantially larger spades 2. In this embodiment, an extension member 22 is provided, which has a base 19 on its lower end, which engages under the lower edge of the grab body 1. Also, this extension member 22 is curved in construction and corresponds to the width of the back 11 of the spade. The pins 3 of the spades are located in the inner sides of the base 19 of the extension member 22. Corresponding recesses 20 are provided in the base for receiving the solid journal bearings 4 located on the backs 11 of the spades. The spacing of the two pins 3 is greater than in the embodiment according to FIGS. 1–3, which has a favorable effect as regards the transmission of forces to the grab body 1 whilst at the same time reducing wear. In the arrangement of spades according to FIG. 4, first, the curved extension members 22 are located on the periphery of the grab body 1 and secured in the axial direction by screws, retaining pins, or similar means. The levers 6 of the embodiments according to FIGS. 1–3 must be substituted by appropriately longer levers 6, whereupon the pins 3 must be inserted in the extension members 22 for securing the spades 2.

Figure 5:
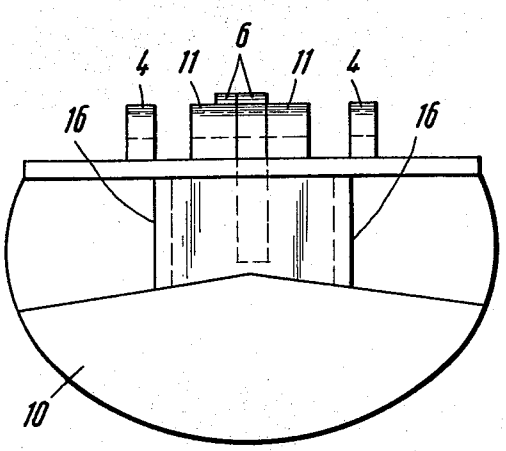
FIG. 5 is a section through a spade equipped with oblique transition walls.
Figure 6:
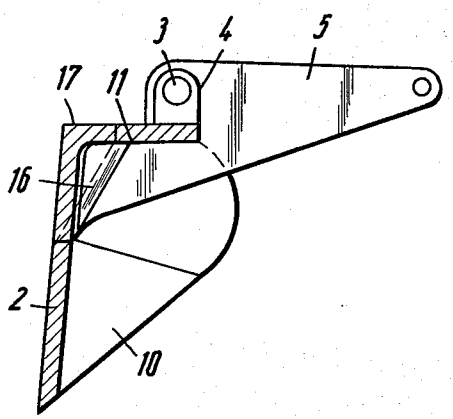
FIG. 6 is a front view according to FIG. 5.

FIGS. 5 and 6 show a grab spade 2 in cross-section and in front view, in which the back 11 of the grab spade passes into the blade 10 of the spade by an obliquely inclined wall. In order to ensure reliable and complete support of the back of the spade on the extension members 14 and 22 with spades of this type, right-angled projections 17 are provided which bridge the obliquely inclined wall 16 and form the back of a spade which corresponds to the size of the spade. The projections 17 are detachably connected to the spade 2.

What is claimed is as follows:

1. A drilling grab for pile foundations and well boreholes comprising:

a grab body;

circular grab spades supported at the grab body end, which spades tilt from an open position into a closed position about pins located in the grab body; and a radially projecting abutment interchangeably connected to the outer periphery of said grab body and engageable by the backs of the grab spades when located in the open position, said abutment overlapping the periphery of the grab body and characterized in that the abutment consists of extension members adapted to grab spades of different size, which members are supported on radially projecting ribs located on the grab body; on the extension members' surfaces adjacent the ribs, the extension members have a thickness corresponding to the thickness of the ribs and at their surfaces coming into engagement with the backs of the grab spades, the extension members have a surface adapted to the respective size of the spade.

2. The drilling grab according to claim 1 wherein the spades slightly overlap the periphery of the grab body and characterized in that the extension members are constructed as cross-pieces arranged at intervals.

3. The drilling grab according to claim 1 wherein the blades overlap the diameter of the grab body to a greater extent and characterized in that the extension members are curved members corresponding to the thickness of the back of the grab spades, which members have two fork-like sides open on the underside.

4. The drilling grab as defined in claim 3 characterized in that the lateral surface of the grab body is constructed to extend in the form of a dove-tail, and the internal side of the curved extension member has grooves corresponding to the dove-tail to permit the attachment of the extension member thereto.

5. The drilling grab according to claim 1 with spades which pass into the blade at the end of the back, by a wall inclined obliquely outwards, characterized in that right-angled projections are provided bridging the obliquely inclined wall, which projections may be supported on the extension members when the spades are open and are detachably connected to the spades.

6. The drilling grab according to claim 1 with spades overlapping the grab body, characterized in that the radii of curvature of the spades are dimensioned such that in the closed position, the spades are located inside the peripheral line of the grab body when the extension members are removed.

7. The drilling grab according to claim 1 characterized in that the curved extension members are provided with downwardly directed bases overlapping the edge of the grab body and receiving the spades, which bases are provided on their inner sides with recesses arranged at intervals for receiving solid journal bearings of the spades.

8. The drilling grab as defined in claim 1 wherein the blades overlap the diameter of the grab body to a greater extent and are characterized in that the extension members are curved members corresponding to the thickness of the back of the grab spade, the lateral surfaces of the grab body being constructed to extend in the form of a dove-tail and the internal sides of the curved extension members having grooves corresponding to the dove-tails to permit the attachment of the extension members to the grab body.

* * * * *